US006389949B1

(12) United States Patent
Carreira

(10) Patent No.: US 6,389,949 B1
(45) Date of Patent: May 21, 2002

(54) SHIELDING DEVICE

(76) Inventor: Andre P. Carreira, P.O. Box 184, Kaaawa, HI (US) 96730

( * ) Notice: Subject to any disclaimer, the term of this patent is extended or adjusted under 35 U.S.C. 154(b) by 0 days.

(21) Appl. No.: 09/580,995

(22) Filed: May 27, 2000

(51) Int. Cl.[7] ..... F41H 5/08
(52) U.S. Cl. ..... 89/36.07; 89/36.02; 2/2.5
(58) Field of Search ..... 89/36.07, 36.05, 89/36.02; 2/2.5

(56) References Cited

U.S. PATENT DOCUMENTS 3,858,241 A * 1/1975 Durand et al. ..... 2/2.5
4,674,394 A * 6/1987 Martino ..... 89/36.05
4,782,735 A * 11/1988 Mui et al. ..... 89/36.07
5,241,703 A * 9/1993 Roberts et al. ..... 2/2.5
5,329,636 A * 7/1994 Siddle ..... 2/463
5,377,577 A * 1/1995 Bounkong et al. ..... 89/36.05
5,641,934 A * 6/1997 Follett ..... 89/36.05
5,850,052 A * 12/1998 Gabriel ..... 89/36.05

FOREIGN PATENT DOCUMENTS

JP 07305999 A * 11/1995

* cited by examiner

*Primary Examiner*—Charles T. Jordan
*Assistant Examiner*—John W. Zerr

(57) ABSTRACT

A shielding device for protecting an individual during a conflict with one or more persons. The inventive device includes a core member, a plurality of cutouts within the core member, a length of edging secured about the perimeter of the core member, a pair of handle members attached to a rear surface of the core member, a cover formed for fitting over the core member, a plurality of hook and loop fasteners for securing the cover about the core member, and a pair of handle covers that are removably attachable to the handle members. The core member is constructed of a rigid material such as metal. The cover is constructed of a body armor cloth-like material for deflecting high velocity projectiles such as bullets.

9 Claims, 3 Drawing Sheets

SHIELDING DEVICE

BACKGROUND OF THE INVENTION

1. Field of the Invention

The present invention relates generally to shields and more specifically it relates to a shielding device for protecting an individual during a conflict with one or more persons.

2. Description of the Prior Art

Shield devices have been in use for years. Typically, a shield device is comprised of a solid structure often utilized with riot gear. The shield device typically has one handle which requires the user to grasp and support the shield.

Conventional shields are typically a solid rectangular structure which require the user to push the shield to the side to aim their firearm thereby exposing their body to opposing gun fire and attacks. Conventional shields also do not allow the user to remove a cover for cleaning stains and other debris from the cover. In addition, conventional shield devices require the user to support the entire weight of the shield with their hand thereby becoming extremely heavy to support over extended periods of time.

Examples of patented shield devices include U.S. Pat. No. 4,412,495 to Sankar; U.S. Pat. No. 4,843,947 to Bauer et al.; U.S. Pat. No. 4,674,394 to Martino; U.S. Pat. No. 4,782,735 to Mui et al.; U.S. Pat. No. 5,850,052 to Gabriel; U.S. Pat. No. 5,787,820 to Dittoe; U.S. Pat. No. 5,392,686 to Sankar; U.S. Pat. No. 4,919,037 to Mitchell; U.S. Pat. No. 4,546,863 to Kaufman; U.S. Pat. No. 3,848,547 to Schaefer which are all illustrative of such prior art.

While these devices may be suitable for the particular purpose to which they address, they are not as suitable for protecting an individual during a conflict with one or more persons. Conventional shield devices are difficult to utilize and operate.

In these respects, the shielding device according to the present invention substantially departs from the conventional concepts and designs of the prior art, and in so doing provides an apparatus primarily developed for the purpose of protecting an individual during a conflict with one or more persons.

SUMMARY OF THE INVENTION

In view of the foregoing disadvantages inherent in the known types of shield devices now present in the prior art, the present invention provides a new shielding device construction wherein the same can be utilized for protecting an individual during a conflict with one or more persons.

The general purpose of the present invention, which will be described subsequently in greater detail, is to provide a new shielding device that has many of the advantages of the shield devices mentioned heretofore and many novel features that result in a new shielding device which is not anticipated, rendered obvious, suggested, or even implied by any of the prior art shield devices, either alone or in any combination thereof.

To attain this, the present invention generally comprises a core member, a plurality of cutouts within the core member, a length of edging secured about the perimeter of the core member, a pair of handle members attached to a rear surface of the core member, a cover formed for fitting over the core member, a plurality of hook and loop fasteners for securing the cover about the core member, and a pair of handle covers that are removably attachable to the handle members. The core member is constructed of a rigid material such as metal. The cover is constructed of a body armor cloth-like material for deflecting high velocity projectiles such as bullets.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a shielding device that will overcome the shortcomings of the prior art devices.

A second object is to provide a shielding device for protecting an individual during a conflict with one or more persons.

Another object is to provide a shielding device that is easy to grasp and support by an individual.

An additional object is to provide a shielding device that can be utilized by an individual over extended periods of time.

A further object is to provide a shielding device that has a removable cover that can be cleaned.

Another object is to provide a shielding device that neutralizes the velocity of bullets and other projectiles.

A further object is to provide a shielding device that distributes the overall weight over the entire arm of the user.

An additional object is to provide a shielding device that is comprised of a metal core and a custom sewn ballistic body armor material with multiple layers.

Another object is to provide a shield device that allows an individual to rest a firearm against the side during a conflict.

A further object is to provide a shield device that can be utilized everyday by an individual.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
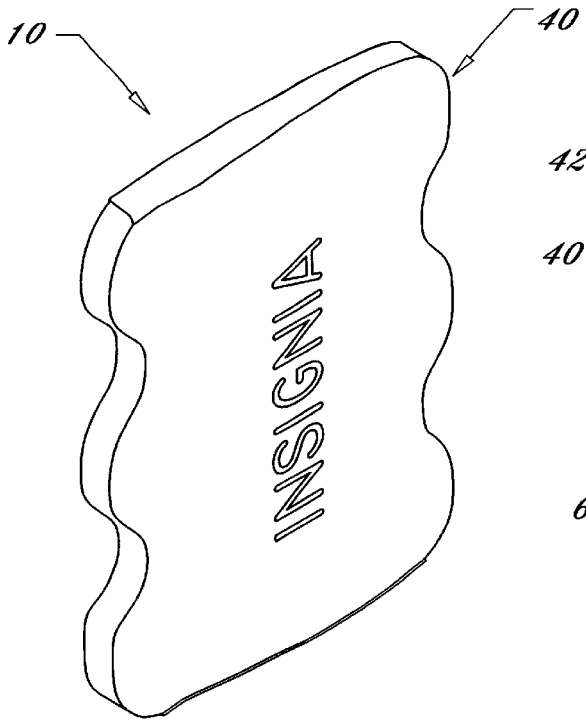
FIG. 1 is an upper perspective view of the core member.

Turning now descriptively to the drawings, in which similar reference characters denote similar elements throughout the several views, FIGS. 1 through 7 illustrate a shielding device 10, which comprises a core member 20, a plurality of cutouts 26 within the core member 20, a length of edging 70 secured about the perimeter of the core member 20, a pair of handle members 30 attached to a rear surface 24 of the core member 20, a cover 40 formed for fitting over the core member 20, a plurality of hook and loop fasteners 50 for securing the cover 40 about the core member 20, and a pair of handle covers 60 that are removably attachable to the handle members 30. The core member 20 is constructed of a rigid material such as metal. The cover 40 is constructed of a body armor cloth-like material for deflecting high velocity projectiles such as bullets.

Figure 3:
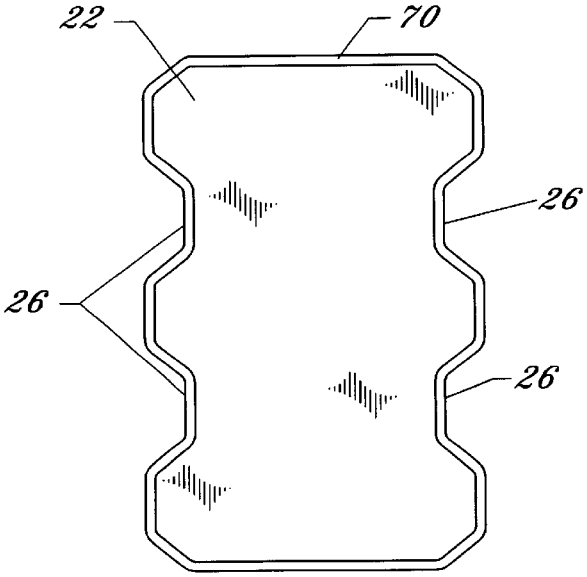
FIG. 3 is a front view of the core member.
Figure 4:
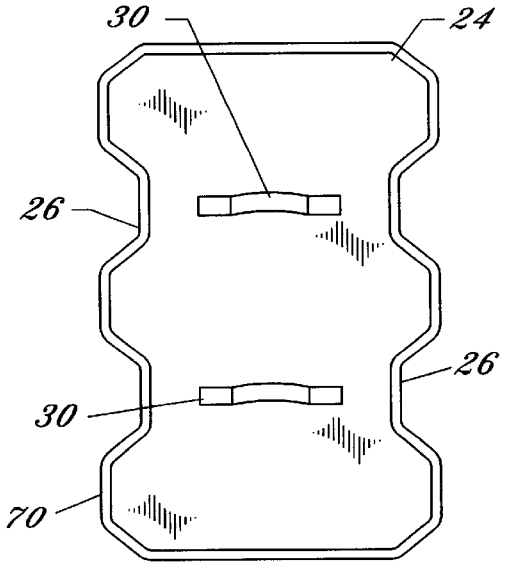
FIG. 4 is a rear view of the core member.
Figure 6:
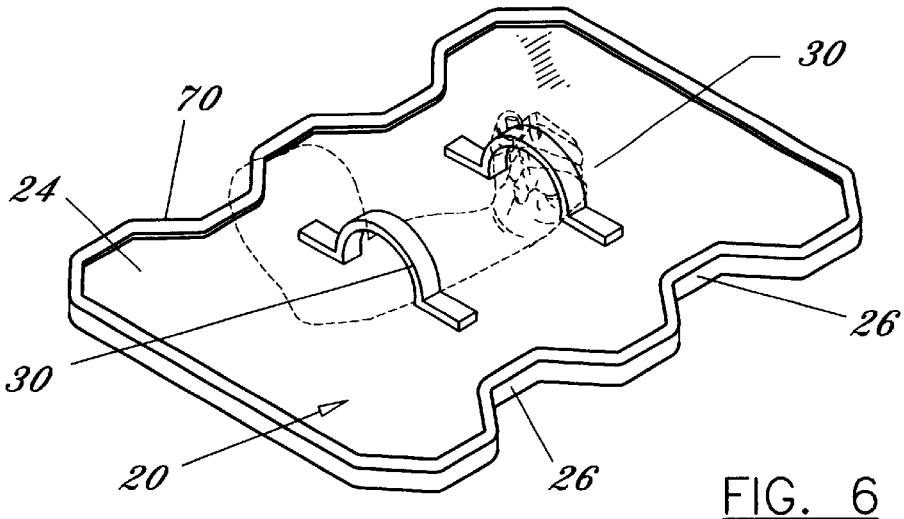
FIG. 6 is an upper perspective view of the core member with an arm of a user positioned within the handles.
Figure 7:
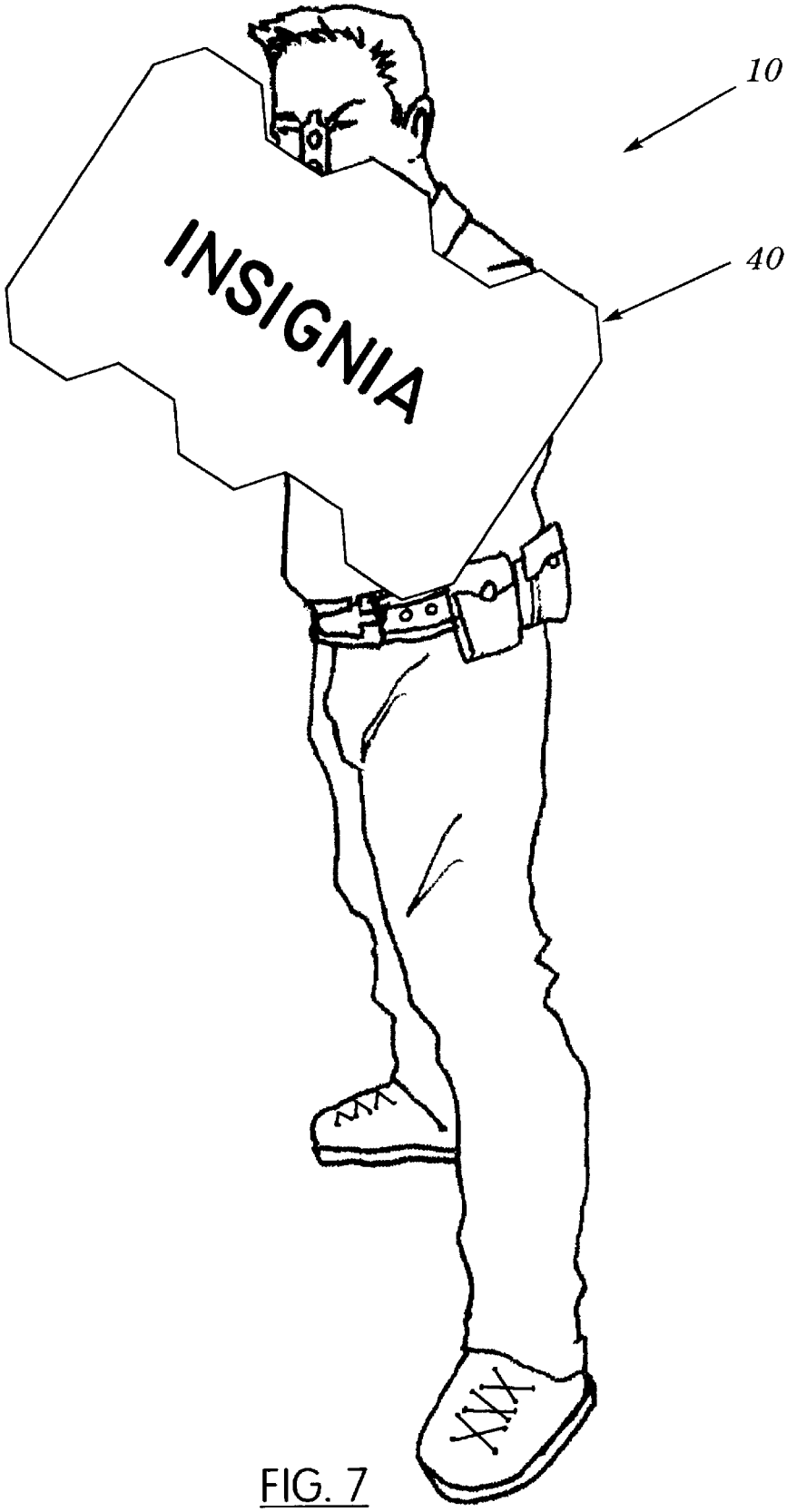
FIG. 7 is a front view of the present invention supported by a user.

As shown in FIGS. 3, 4 and 6 of the drawings, the core member 20 has a front surface 22 and a rear surface 24. As further shown in the figures, the core member 20 is constructed of a generally flat construction. The core member 20 may be constructed of any well-known rigid material such as metal or plastic. The core member 20 may be constructed of platinum, titanium or steel.

As best shown in FIGS. 3 and 4 of the drawings, the core member 20 includes a plurality of cutouts 26. The cutouts 26 preferably have a semi-trapezoid or U-shaped structure, however it can be appreciated that various other shapes may be utilized for the cutouts 26. The cutouts 26 allow the user to view objects and individuals in front of them without removing the protective features of the present invention. There are preferably two cutouts 26 within opposing sides of the core member 20, however various other configurations for the cutouts 26 may be utilized.

As shown in FIGS. 3, 4, and 6 of the drawings, a length of edging 70 is attached about the outer perimeter of the core member 20 for providing a cushion for the user during utilization of the present invention. The edging 70 is constructed of a resilient cushion material such as foam rubber.

As shown in FIGS. 4 and 6 of the drawings, a pair of handles are secured to the rear surface 24 of the core member 20. The handles are secured to the core member 20 by a conventional securing means such as welding or fasteners. The handles are preferably a looped structure large enough for receiving the wrist and forearm of the user during operation.

Figure 2:
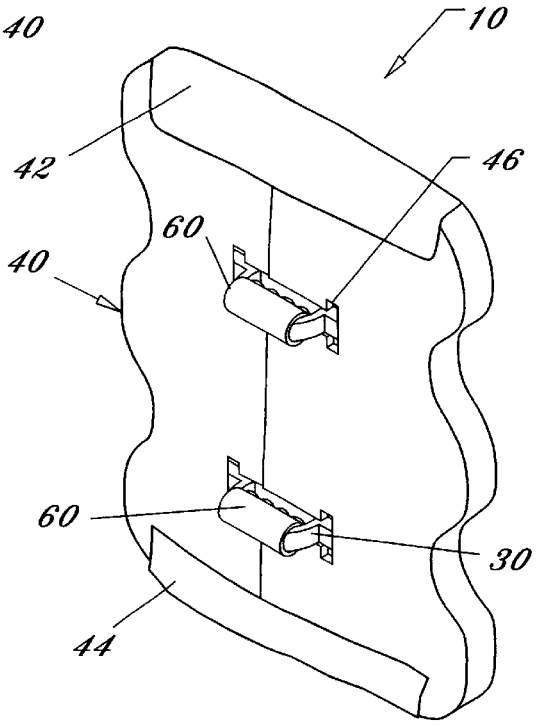
FIG. 2 is a rear upper perspective view of the present invention.
Figure 5:
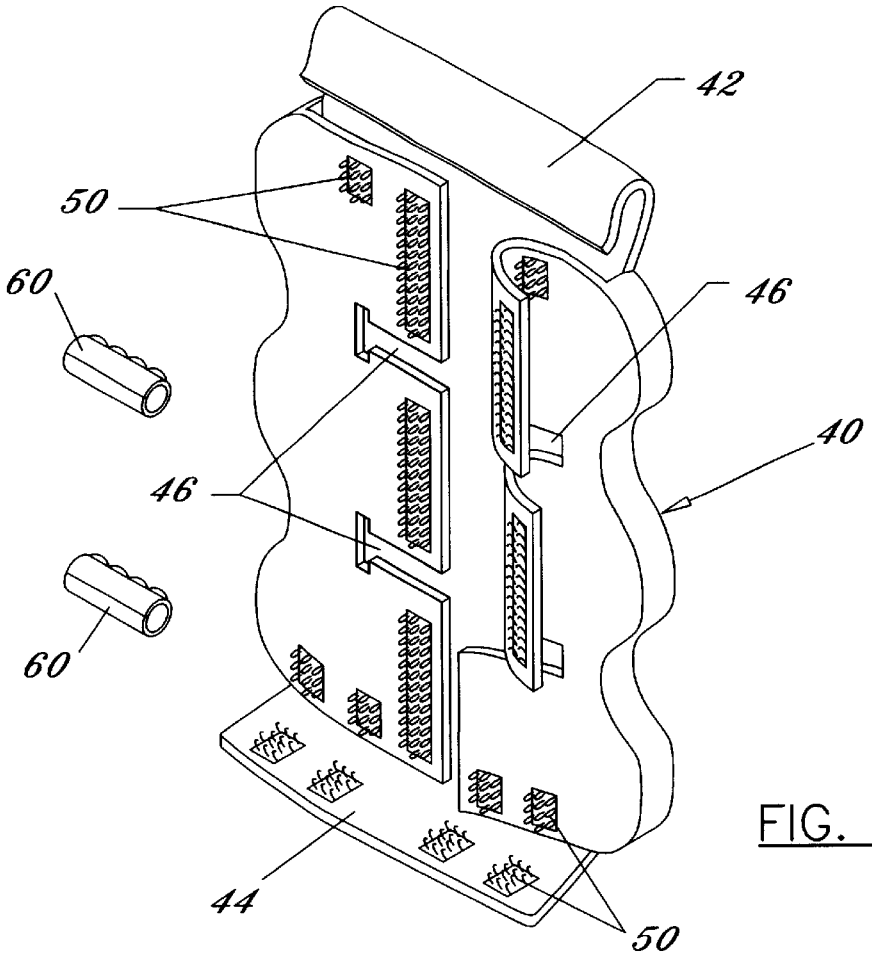
FIG. 5 is a rear upper perspective view of the cover.

As shown in FIGS. 1, 2, and 5 of the drawings a cover 40 is provided that is removably positionable about the core member 20. The cover 40 is formed to the shape of the core member 20. The cover 40 is constructed of a bullet proof material such as KEVLAR. The cover 40 has a first flap 42 and a second flap 44 as shown in FIGS. 2 and 5 of the drawings. A plurality of fasteners 50 attached to the cover 40 allow securing of the cover 40 about the core member 20. The plurality of fasteners 50 are comprised of a fastener such as hook and loop fasteners 50.

As shown in FIGS. 2 and 5 of the drawings, a plurality of slots 46 extend into the rear portion of the cover 40 for receiving the handle members 30. The slots 46 preferably have a T-shape for receiving the broader portion of the handle members 30.

A pair of handle covers 60 are further provided that secure about the handle members 30 for providing cushioning for the hand and arms of the user. The handle covers 60 preferably are removably attached to the handle members 30 with hook and loop fasteners.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shielding device, comprising:

a rigid core member having a longitudinal axis, a front surface, a rear surface, an outer perimeter, and a plurality of cutouts extending into opposing sides wherein said opposing sides are parallel to said longitudinal axis are wherein said plurality of cutouts are comprised of a semi-trapezoid shape in a tapered structure;

a plurality of handle members secured to said rear surface of said core member;

a cover removably positioned about said core member and formed to the shape of said core member, wherein said cover includes a main body portion with two opposing ends and a pair of opposing flaps attachable to one another by a hook and loop fastener; and wherein said cover is comprised of a bullet resistant material.

2. The shielding device of claim 1, including a plurality of handle covers secured about said handle members.

3. The shielding device of claim 2, wherein said handle covers are removably connected about said handle members.

4. The shielding device of claim 3, wherein said handle covers include a cushion material.

5. The shielding device of claim 1, wherein said core member includes a length of edging about an outer perimeter of said core member.

6. A shielding device, comprising:

a rigid core member having a longitudinal axis, a front surface, a rear surface, an outer perimeter, and a plurality of cutouts extending into opposing sides wherein said opposing sides are parallel to said longitudinal axis and wherein said plurality of cutouts are comprised of a semi-trapezoid shape in a tapered structure;

a plurality of handle members secured to said rear surface of said core member, said handle members having a position traverse to said longitudinal axis of said core member;

a cover removably positioned about said core member and formed to the shape of said core member, wherein said cover includes a main body portion with two opposing ends and a pair of opposing flaps;

a means for fastening said opposing ends to one another and said opposing flaps to said main body portion;

wherein said cover is comprised of a bullet resistant material and includes a plurality of slots for receiving said handle members; and a length of edging positioned about 100 percent of said outer perimeter of said core member.

7. The shielding device of claim 6, including a plurality of handle covers secured about said handle members.

8. The shielding device of claim 7, wherein said handle covers are removably connected about said handle members.

9. The shielding device of claim 8, wherein said handle covers include a cushion material.

* * * * *